US007042205B2

(12) United States Patent
Tseng et al.

(10) Patent No.: US 7,042,205 B2
(45) Date of Patent: May 9, 2006

(54) REFERENCE VOLTAGE GENERATOR WITH SUPPLY VOLTAGE AND TEMPERATURE IMMUNITY

(75) Inventors: Chien-Chung Tseng, Hsinchu (TW); Chih-Neng Hsu, Hsinchu (TW)

(73) Assignee: Macronix International Co., Ltd., Hsinchu (TW)

( * ) Notice: Subject to any disclaimer, the term of this patent is extended or adjusted under 35 U.S.C. 154(b) by 0 days.

(21) Appl. No.: 10/608,612

(22) Filed: Jun. 27, 2003

(65) Prior Publication Data

US 2004/0263144 A1 Dec. 30, 2004

(51) Int. Cl.
*G05F 3/16* (2006.01)
*G05F 3/20* (2006.01)

(52) U.S. Cl. ..... 323/315; 323/313; 323/314

(58) Field of Classification Search ..... 323/313, 323/314, 315

See application file for complete search history.

(56) References Cited

U.S. PATENT DOCUMENTS

| | | | | |
|---|---|---|---|---|
| 5,315,230 | A * | 5/1994 | Cordoba et al. | 323/313 |
| 5,675,243 | A * | 10/1997 | Kamata | 323/313 |
| 5,961,215 | A * | 10/1999 | Lee et al. | 374/178 |
| 6,087,820 | A * | 7/2000 | Houghton et al. | 323/315 |
| 6,466,081 | B1 * | 10/2002 | Eker | 327/541 |
| 6,570,436 | B1 * | 5/2003 | Kronmueller et al. | 323/315 |
| 6,667,653 | B1 * | 12/2003 | Kronmueller et al. | 323/312 |
| 6,799,889 | B1 * | 10/2004 | Pennock | 323/315 |

* cited by examiner

*Primary Examiner*—Bao Q. Vu
(74) *Attorney, Agent, or Firm*—Stout, Uxa, Buyan & Mullins, LLP

(57) ABSTRACT

A reference voltage generator includes a first current source, an output current mirror, an output device, and a shunt device. The first current source generates a first current and has a first temperature coefficient. The output current mirror mirrors the first current and generates a second current in response to the first current. The output device provides a reference voltage in response to the second current. The shunt device has a second temperature coefficient that is complementary to the first temperature coefficient, and is operatively coupled in parallel with the output device.

19 Claims, 3 Drawing Sheets

REFERENCE VOLTAGE GENERATOR WITH SUPPLY VOLTAGE AND TEMPERATURE IMMUNITY

BACKGROUND OF THE INVENTION

1. Field of the Invention

The present invention relates generally to reference voltage generators, and more particularly, to reference voltage generators with supply voltage and temperature immunity.

2. Description of Related Art

Reference voltage generators have traditionally been temperature dependent. As temperature changes, a reference voltage produced by the reference voltage generator has traditionally changed accordingly. A need thus exists in the prior art to provide a reference voltage that is substantially unchanged as temperature changes.

SUMMARY OF THE INVENTION

The present invention addresses the above-stated need by providing a reference voltage generator that provides a reference voltage at a reference voltage node. The reference voltage can be substantially invariant with respect to temperature. A reference voltage with supply voltage and temperature immunity is generated by applying the gate-source voltage difference of a PMOS transistor across a first resistive element to generate a current and mirroring the current on a second resistive element connected with an NMOS transistor in parallel to compensate for the variations in the current of the PMOS transistor.

Any feature or combination of features described herein are included within the scope of the present invention provided that the features included in any such combination are not mutually inconsistent as will be apparent from the context, this specification, and the knowledge of one skilled in the art. For purposes of summarizing the present invention, certain aspects, advantages and novel features of the present invention have been described herein. Of course, it is to be understood that not necessarily all such aspects, advantages or features will be embodied in any particular embodiment of the present invention. Additional advantages and aspects of the present invention are apparent in the following detailed description and claims.

BRIEF DESCIRPTION OF THE DRAWINGS

DETAILED DESCRIPTION OF THE PRESENTLY PREFERRED EMBODIMENTS

Figure 2:
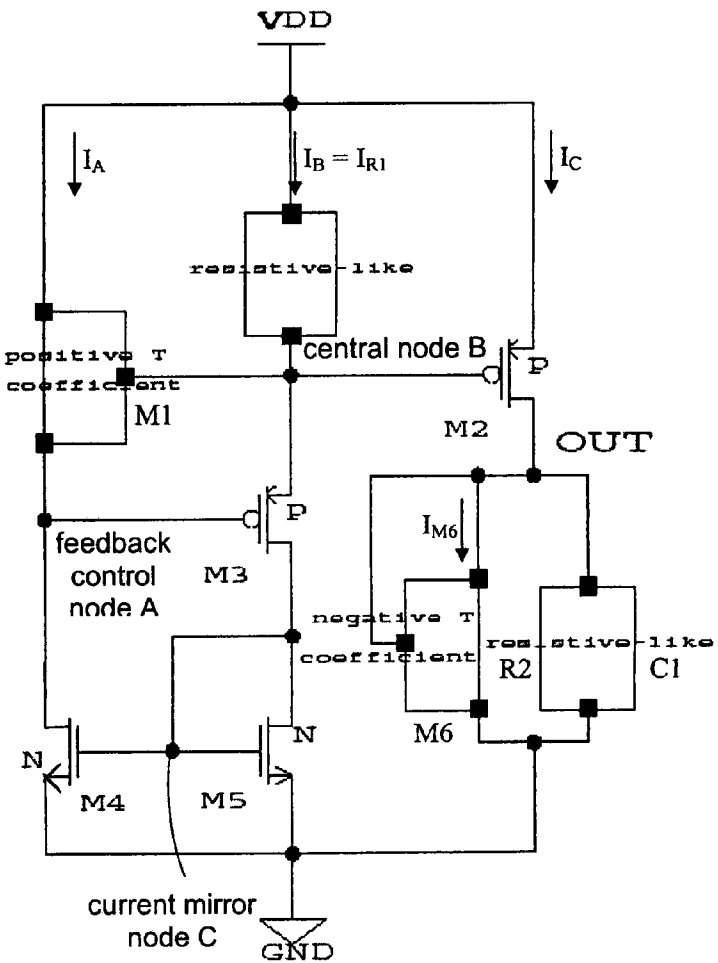
FIG. 2 is a schematic diagram of a second circuit in accordance with another illustrated embodiment of the present invention.

Reference will now be made in detail to the presently preferred embodiments of the invention, examples of which are illustrated in the accompanying drawings. Wherever possible, the same or similar reference numbers are used in the drawings and the description to refer to the same or like parts. It should be noted that the drawings are in simplified form and are not to precise scale. In reference to the disclosure herein, for purposes of convenience and clarity only, directional terms, such as, top, bottom, left, right, up, down, over, above, below, beneath, rear, and front, are used with respect to the accompanying drawings. Such directional terms should not be construed to limit the scope of the invention in any manner.

Although the disclosure herein refers to certain illustrated embodiments, it is to be understood that these embodiments are presented by way of example and not by way of limitation. The intent of the following detailed description, although discussing exemplary embodiments, is to be construed to cover all modifications, alternatives, and equivalents of the embodiments as may fall within the spirit and scope of the invention as defined by the appended claims. It is to be understood and appreciated that the process steps and structures described herein do not cover a complete process flow for the manufacture of a reference voltage generator. The present invention may be practiced in conjunction with various circuits that require a reference voltage, including several techniques that are conventionally used in the art, and only so much of the commonly practiced process steps are included herein as are necessary to provide an understanding of the present invention. The present invention has applicability in the field of supply voltages and temperature immunity in general. For illustrative purposes, however, the following description pertains to a reference voltage generator with supply voltage and temperature immunity.

Figure 1:
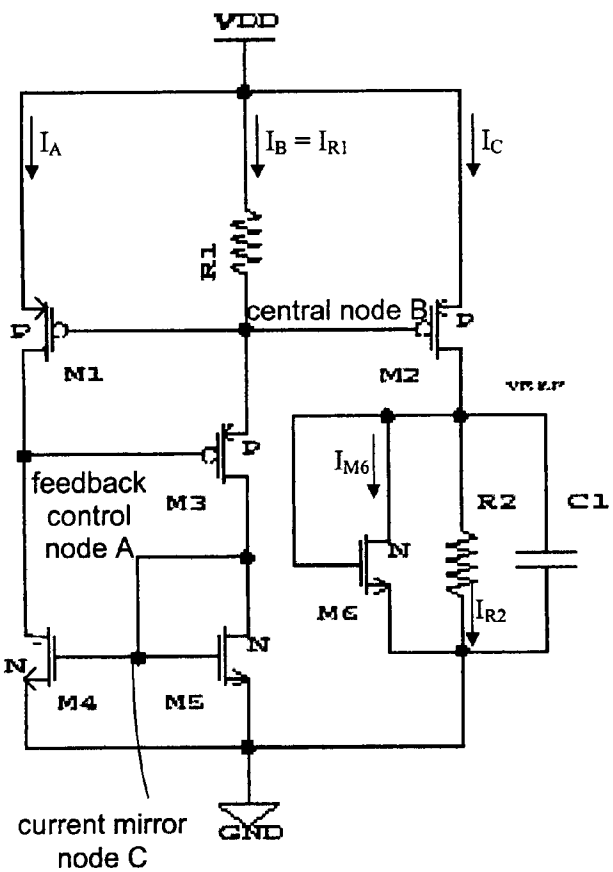
FIG. 1 is a schematic diagram of a first circuit in accordance with an illustrated embodiment of the present invention.

Referring now to FIG. 1, a first circuit in accordance with an illustrated embodiment of the present invention is shown, comprising a first current path $I_A$ including a current source transistor $M_1$ and a feedback transistor $M_4$; a compensation current path $I_B$ including a first resistor $R_1$, a feedback control transistor $M_3$, and a feedback-generating transistor $M_5$; and a second current path $I_C$ including an output transistor $M_2$, a thermal coupling transistor $M_6$, a second resistor $R_2$, and an output capacitor $C_1$.

Referring now to the first current path $I_A$, the current source transistor $M_1$ has a source terminal coupled to a supply signal VDD, a drain terminal coupled to a feedback control node A, and a gate terminal coupled to a central node B. The feedback transistor $M_4$ is an NMOS transistor having a drain terminal coupled to the feedback control node A, a source terminal coupled to a ground node, and a gate terminal coupled to a current mirror node C.

Referring now to the compensation current path $I_B$, the first resistor $R_1$ is coupled between the supply signal $V_{DD}$ and the central node B. The feedback control transistor $M_3$ is a PMOS transistor having a source terminal coupled to the central node B, a drain terminal coupled to the current mirror node C, and a gate terminal coupled to the feedback control node A. The feedback-generating transistor $M_5$ is an NMOS transistor having a source terminal coupled to the ground node, a drain terminal coupled to the current mirror node C, and a gate terminal also coupled to the current mirror node C.

Referring now to the second current path $I_C$, the output transistor $M_2$ is a PMOS transistor having a source terminal coupled to the supply signal $V_{DD}$, a drain terminal coupled to an output node $V_{REF}$, and a gate terminal coupled to the central node B. The thermal coupling transistor $M_6$ has a source terminal coupled to the ground node, and both a drain terminal and a gate terminal coupled to the output node $V_{REF}$. The second resistor $R_2$ and the output capacitor $C_1$ are coupled between the output node $V_{REF}$ and the ground node, such that the second resistor $R_2$ and the output capacitor $C_1$ are in parallel with the gate-source and drain-source voltages of the thermal coupling transistor $M_6$.

Power-up

When power is initially applied to the circuit and the supply signal $V_{DD}$ begins to ramp up to its operational voltage, the voltage at the central node B follows the voltage of the supply signal $V_{DD}$ across the first resistor R1. Current begins to flow through the compensation current path $I_B$ to the central node B, capacitively increasing the voltage of the central node B. Similarly, when power is initially applied to the circuit and the supply signal $V_{DD}$ begins to ramp up to its operational voltage, the voltage at the feedback control node A has a voltage approximately equal to ground voltage. As voltage of the central node B increases while the voltage at the feedback control node A remains approximately zero, current flows through the feedback control transistor $M_3$ to the current mirror node C, capacitively increasing the voltage of the current mirror node C. As the voltage of the current mirror node C increases, current begins to flow through the feedback-generating transistor $M_5$.

When a current path through the feedback control transistor $M_3$ and the feedback-generating transistor $M_5$ begins to form between the central node B and ground through the compensation current path $I_B$, any residual capacitive charge at the central node B is discharged. As the voltage at the central node B is reduced, a quiescent current begins to flow through the first resistor R1, creating a voltage difference between the supply signal $V_{DD}$ and the central node B.

The First Current Path $I_A$ and the Compensation Current Path $I_B$

Within the first current path $I_A$, the voltage difference between the supply signal $V_{DD}$ and the central node B imposes a gate-to-source voltage $V_{GS1}$ on the current source transistor $M_1$. The gate-to-source voltage $V_{GS1}$ causes a current to flow through the current source transistor $M_1$ and through the first current path $I_A$. Current through the first current path $I_A$ passes through the current source transistor $M_1$ and through the feedback transistor $M_4$ to ground.

Within the compensation current path $I_B$, the voltage difference between the supply signal $V_{DD}$ and the central node B further creates a current in the compensation current path $I_B$ through the first resistor $R_1$. In accordance with Ohm's law, the current in the compensation current path $I_B$ is $I_B=V_{GS1}/R_1$. The current passes through the first resistor $R_1$ and through both the feedback control transistor $M_3$ and through the feedback-generating transistor $M_5$ to ground.

The reference voltage generator therefore has a first current source, i.e., the current source transistor $M_1$, that generates the first current $I_A$. The current source transistor $M_1$ has a first temperature coefficient, which is generally positive since the current source transistor $M_1$ is a PMOS transistor. With changes in temperature, the current source transistor $M_1$ can apply a gate-source voltage difference on the first resistive element (i.e., the first resistor $R_1$), generate a first current through the current source transistor $M_1$, and conduct a compensation current through the first resistor R1.

The compensation current varies in response to the first current, such that a one-to-one correspondence exists between the compensation current and the first current. In other words, for any given first current through the current source transistor $M_1$, only one compensation current through the first resistor $R_1$ is possible. Moreover, as the first current through the current source transistor $M_1$ increases, the compensation current through the first resistor $R_1$ also increases; and as the first current through the current source transistor $M_1$ decreases, the compensation current through the first resistor $R_1$ also decreases.

Advantageously, the feedback-generating transistor $M_5$ and the feedback transistor $M_4$ form a feedback current mirror that stabilizes the current through the first current path $I_A$ and the current through the compensation current path $I_B$. If the current through the compensation current path $I_B$ increases, for example, then the gate-to-source voltage of the feedback-generating transistor $M_5$ increases accordingly, increasing the gate-to-source voltage of the feedback transistor $M_4$ across the feedback current mirror formed by the feedback-generating transistor $M_5$ and the feedback transistor $M_4$. The consequently greater voltage at the feedback control node A restricts the current through the feedback control transistor $M_3$, curtailing the current through the compensation current path $I_B$.

Similarly, if the current through the compensation current path $I_B$ decreases, then the gate-to-source voltage of the feedback-generating transistor $M_5$ decreases accordingly, decreasing the gate-to-source voltage of the feedback transistor $M_4$ across the feedback current mirror formed by the feedback-generating transistor $M_5$ and the feedback transistor $M_4$. The consequently lower voltage at the feedback control node A allows more current to flow through the feedback control transistor $M_3$, increasing the current through the compensation current path $I_B$.

The feedback control transistor $M_3$ is a feedback element that conducts the compensation current such that the compensation current varies inversely in response to the first current. In other words, as the first current increases, raising the voltage of the feedback control node A, the compensation current decreases, and as the first current decreases, lowering the voltage of the feedback control node A, the compensation current increases. The feedback element and the first resistor $R_1$ (i.e., a compensation element) operate to restore the first current to a substantially constant first current.

Thus, there are two independent relationships between the first current path $I_A$ and the compensation current path $I_B$. First, the voltage across the gate and source terminals of the current source transistor $M_1$ (i.e., the voltage difference between the supply signal $V_{DD}$ and the central node B) is equal to the voltage across the first resistor R. Second, the current through the feedback-generating transistor $M_5$ is related to the feedback transistor $M_4$ across the feedback current mirror. The two independent relationships provide a restorative feedback that inhibits fluctuations in the current through the first current path $I_A$ (and the current through the compensation current path $I_B$). Since the gate and drain terminals of M5 are connected together, the Vgs of M5 equals the Vds (i.e., the voltage difference between the drain terminal and the gate terminal) of M5. The Vds of the transistor M5 is greater than Vgs−Vt. Therefore M5 will operate within the saturation region. Since M5 operates within the saturation region, Ids=k(W/L)(Vgs−Vt)(Vgs−Vt). In other words, if the dimensions of M4 and M5 are equal, then the current through M4 will be equal to that of M5.

The First Current Path $I_A$ and the Second Current Path $I_C$

The voltage difference $V_{GS1}$ of the current source transistor $M_1$ is further mirrored on the output transistor $M_2$ to produce a current through the second current path $I_C$. In other words, the current source transistor $M_1$ and the output transistor $M_2$ form an output current mirror that produces a current through the second current path $I_C$.

A current divider serves to stabilize the voltage at the output node $V_{REF}$ by stabilizing the current through the thermal coupling transistor $M_6$ and through the second resistor $R_2$. The second resistor $R_2$ is an output device that is operative to provide a reference voltage in response to the second current. The current through the second current path $I_C$ is divided between the thermal coupling transistor $M_6$ and the second resistor $R_2$. The voltage at the output node $V_{REF}$ is applied as a gate-to-source voltage of the thermal coupling transistor $M_6$, causing a current $I_{M6}$ to flow through the thermal coupling transistor $M_6$. The voltage at the output node $V_{REF}$ is also applied across the second resistor $R_2$, corresponding to flow of a current $I_{R2}$ through the second resistor $R_2$.

When the output capacitor $C_1$ draws no current, the current $I_{M6}$ through the thermal coupling transistor $M_6$ and the current $I_{R2}$ through the second resistor $R_2$ may be added together to total the current through the second current path $I_C$. If the voltage at the output node $V_{REF}$ increases, the resulting increase in gate-to-source voltage across the thermal coupling transistor $M_6$ draws more current through the thermal coupling transistor $M_6$, attenuating the current through the second resistor $R_2$ and thereby restoring voltage at the output node $V_{REF}$.

Similarly, if the voltage at the output node $V_{REF}$ decreases, the resulting decrease in gate-to-source voltage across the thermal coupling transistor $M_6$ restricts current through the thermal coupling transistor $M_6$ and diverts more of the current through the second current path $I_C$ toward the second resistor $R_2$, thereby restoring the voltage at the output node $V_{REF}$. Since the current-to-voltage relationship of the thermal coupling transistor $M_6$ is independent of the current-to-voltage relationship of the second resistor $R_2$, while the voltages (the voltage at the output node $V_{REF}$) are identical and the current must total the current through the second current path $I_C$, the two independent current-to-voltage relationships provide a restorative feedback that maintains the voltage at the output node $V_{REF}$ substantially constant.

The temperature dependence of the current source transistor $M_1$ is removed by compensation with the thermal coupling transistor $M_6$, in combination with the first resistor $R_1$ and the second resistor $R_2$. The current source transistor $M_1$ and the thermal coupling transistor $M_6$ have complementary thermal coefficients. The current source transistor $M_1$ is a PMOS transistor, and consequently may be expected to have a positive temperature coefficient. As temperature increases, current $I_A$ through the current source transistor $M_1$ may be expected to increase. The increase in current is mirrored into the second current path $I_C$ across the output current mirror formed by the current source transistor $M_1$ and the output transistor $M_2$, increasing the current through the parallel combination of the thermal coupling transistor $M_6$ and the second resistor $R_2$. Without temperature compensation, the output reference voltage would vary with $V_{GS1}$, in accordance with the relationship:

$$V_{REF}=V_{GS1}*(R_2/R_1), \text{ or}$$

$$\partial V_{REF}/\partial T=(R_2/R_1)(\partial V_{GS1}/\partial T)>0, \text{ where } T=\text{temperature.}$$

The thermal coupling transistor-like element M6 provides the necessary thermal compensation to maintain the output reference voltage regardless of thermal variations in VGS1. The thermal coupling transistor-like element M6 is a PMOS transistor, and consequently may be expected to have a positive temperature coefficient. As temperature increases, current through the thermal coupling transistor-like element M6 may be expected to increase, shunting a greater current from the second resistor R2 and allowing the voltage across the second resistor R2 to remain constant despite a greater current through the first resistor R1. Similarly, as temperature decreases, current through the thermal coupling transistor-like element M6 may be expected to decrease, diverting a greater portion of the first current from the first resistor R1 into the second resistor R2 and (again) allowing the voltage across the second resistor R2 to remain constant despite a greater current through the first resistor R1. However, the increased current flow through the second resistor $R_2$ will increase the voltage across the second resistor $R_2$, thereby increasing current flow through the thermal coupling transistor $M_6$ and offsetting the temperature-induced decrease of current through the thermal coupling transistor $M_6$. The thermal coupling transistor $M_6$ is thus a shunt device that has a temperature coefficient which is complementary to the first temperature coefficient, being operatively coupled in parallel with the second resistor R2 and being operative to restore the reference voltage in response to temperature-dependent variations in the first current.

Threshold Voltage Drops

An examination of various threshold voltage drops through the circuit provides additional insight into the operation of the circuit. Across either the current source transistor $M_1$ or the output transistor $M_2$, the voltage of the central node B is one PMOS threshold voltage drop below the voltage of the supply signal $V_{DD}$. Across either the current source transistor $M_1$ or the feedback control transistor $M_3$, the feedback control node A is one PMOS threshold voltage drop below the voltage of the central node B, and across the output transistor $M_2$ the output node $V_{REF}$ is one PMOS threshold voltage drop below the voltage of the central node B. If the current source transistor $M_1$, the output transistor $M_2$, and the feedback control transistor $M_3$ are fabricated from a uniform doping concentration and are symmetric with respect to drain and source, then the voltage at the feedback control node A is equivalent to the voltage at the output node $V_{REF}$.

Figure 3:
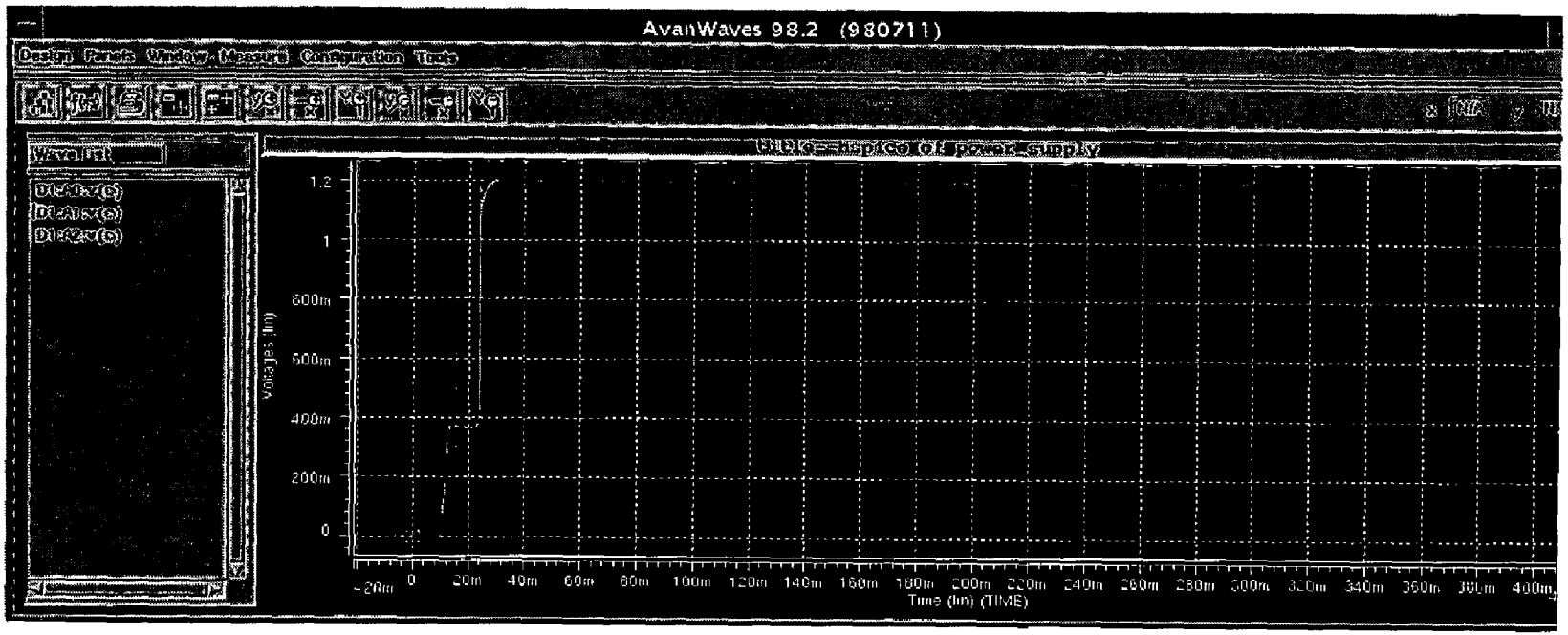
FIG. 3 is a simulation depicting a potential of node C as a function of time in accordance with an illustrated embodiment of the present invention.

Across the feedback-generating transistor $M_5$, which is an NMOS transistor whose gate terminal is connected to its drain terminal and whose source terminal is connected to ground, the voltage of the current mirror node C is one NMOS threshold voltage drop above ground. FIG. 3 is simulation depicting a potential of node C as a function of time wherein a voltage of node C is about 1.2 volts. In the plot, D1:A0:v(c) corresponds to a scenario wherein VDD is 3.0 volts at a temperature of −25 C; D1:A1v(c) corresponds to a scenario wherein VDD is 3.0 volts at a temperature of 25 C; and D1:A3v(c) corresponds to a scenario wherein VDD is 3.0 volts at a temperature of 85 C.

Across the thermal coupling transistor $M_6$, which is an NMOS transistor whose gate terminal is connected to its drain terminal and whose source terminal is connected to ground, the voltage of the output reference node $V_{REF}$ can be interpreted to be two NMOS threshold voltage drops above ground. Thus, a sequence of threshold voltage drops from the supply signal $V_{DD}$ to ground includes two NMOS threshold voltage drops and two PMOS threshold voltage drops. Any positive temperature coefficient of the PMOS transistors can be compensated by a corresponding negative temperature coefficient of the NMOS transistors, resulting in a substantially temperature-independent total voltage drop between the supply signal $V_{DD}$ and ground. As mentioned, the voltage of node $V_{REF}$ is equal to $I_{R2}$*R2. In the illustrated embodiment wherein the value of R2 is fixed, if $I_{R2}$ is also fixed, then the voltage of node $V_{REF}$ is stable. In accordance with current mirror principles, $I_A$ is equal to $I_C$. $I_C$ in turn is equal to $I_{R2}+I_{M6}$. When the components of M1 and M6 are set to have the same or about the same temperature coefficients (e.g., all positive or all negative), then when $I_A$ increases $I_{M6}$ increases also, and vice versa. This behavior can facilitate a stabilization of $I_{R2}$ and $V_{REF}$.

Figure 4:
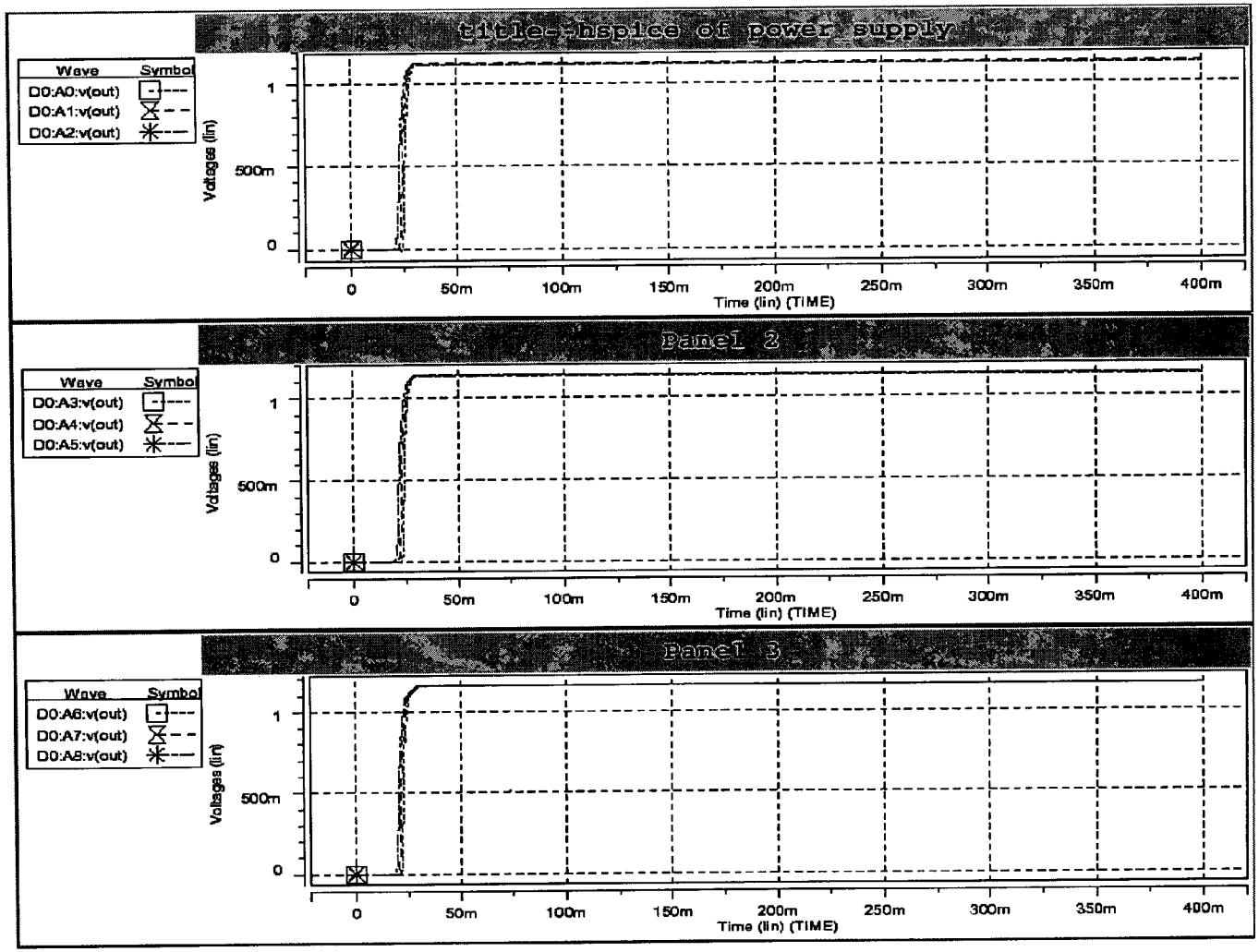
FIG. 4 is a collection of graphs showing various voltages as a function of time in accordance with an illustrated embodiment of the present invention.

Referring now to FIG. 4, a collection of graphs shows various voltage waveforms as a function of time in accordance with the illustrated embodiment of the present invention, wherein v(out) in each plot denotes the potential of the output reference node $V_{REF}$. In the first panel of FIG. 4, D0:A0:v(out) corresponds to a scenario wherein VDD is 3.0 volts at a temperature of −25 C, yielding a relatively slow corner characteristic; D0:A1:v(out) corresponds to a scenario wherein VDD is 3.0 volts at a temperature of 25 C, generating a relatively slow corner characteristic; and D1:A2:v(out) corresponds to a scenario wherein VDD is 3.0 volts at a temperature of 85 C, yielding a relatively slow corner characteristic. In the second panel, D0:A3:v(out) corresponds to a scenario wherein VDD is 3.3 volts at a temperature of −25 C, generating a typical corner characteristic; D0:A4:v(out) corresponds to a scenario wherein VDD is 3.3 volts at a temperature of 25 C, yielding a typical corner characteristic; and D0:A5:v(out) corresponds to a scenario wherein VDD is 3.3 volts at a temperature of 85 C, generating a typical corner characteristic. In the third panel of FIG. 4, D1:A6:v(out) corresponds to a scenario wherein VDD is 3.7 volts at a temperature of −25 C, yielding a relatively fast corner characteristic; D0:A7:v(out) corresponds to a scenario wherein VDD is 3.7 volts at a temperature of 25 C, yielding a relatively fast corner characteristic; and D1:A8:v(out) corresponds to a scenario wherein VDD is 3.7 volts at a temperature of 85 C, generating a relatively fast corner characteristic.

Output Capacitor C1

With further reference to FIG. 1, the output capacitor $C_1$ improves the stability of the output node $V_{REF}$. The output capacitor $C_1$ and the second resistor $R_2$ form an RC circuit that serves to stabilize the output reference voltage at the output node $V_{REF}$ by slowing variations in the output node $V_{REF}$.

The Second Circuit

Turning now to FIG. 2, a second circuit in accordance with the illustrated embodiment of the present invention is shown. The second circuit comprises: a first current path $I_A$ including a current source transistor-like element $M_1$ and a feedback transistor-like element $M_4$; a compensation current path $I_B$ including a first resistive-like element $R_1$, a feedback control transistor-like element $M_3$, and a feedback-generating transistor-like element $M_5$; and a second current path $I_C$ including an output transistor-like element $M_2$, a thermal coupling transistor-like element $M_6$, a second resistive-like element $R_2$, and an output capacitor-like element $C_1$.

Referring now to the first current path $I_A$, the current source transistor-like element $M_1$ can be, for example, a PMOS transistor having a source terminal coupled to a supply signal $V_{DD}$, a drain terminal coupled to a feedback control node A, and a gate terminal coupled to the central node B. The feedback transistor-like element $M_4$ can be, for example, an NMOS transistor having a drain terminal coupled to the feedback control node A, a source terminal coupled to a ground node, and a gate terminal coupled to a current mirror node C.

Referring now to the compensation current path $I_B$, the first resistive-like element $R_1$ is coupled between the supply signal $V_{DD}$ and the central node B. The feedback control transistor-like element $M_3$ can be, for example, a PMOS transistor having a source terminal coupled to the central node B, a drain terminal coupled to the current mirror node C, and a gate terminal coupled to the feedback control node A. The feedback-generating transistor-like element $M_5$ can be, for example, an NMOS transistor having a source terminal coupled to the ground node, a drain terminal coupled to the current mirror node C, and a gate terminal also coupled to the current mirror node C.

Referring now to the second current path $I_C$, the output transistor-like element $M_2$ can be, for example, a PMOS transistor having a source terminal coupled to the supply signal $V_{DD}$, a drain terminal coupled to the output node $V_{REF}$, and a gate terminal coupled to the central node B. The thermal coupling transistor-like element $M_6$ can be, for example an NMOS transistor having a source terminal coupled to the ground node, and both a drain terminal and a gate terminal coupled to the output node $V_{REF}$. The second resistive-like element $R_2$ and the output capacitor-like element $C_1$ are coupled between the output node $V_{REF}$ and the ground node, such that the second resistive-like element $R_2$ and the output capacitor-like element $C_1$ are in parallel with the gate-source and drain-source voltages of the thermal coupling transistor-like element $M_6$.

Power-up

When power is initially applied to the second circuit (i.e., the circuit of FIG. 2) and the supply signal $V_{DD}$ begins to ramp up to its operational voltage, the voltage at the central node B follows the voltage of the supply signal $V_{DD}$ across the first resistive-like element R1. Current begins to flow through the compensation current path $I_B$ to the central node B, capacitively increasing the voltage of the central node B. Similarly, when power is initially applied to the second circuit and the supply signal $V_{DD}$ begins to ramp up to its operational voltage, the voltage at the feedback control node A has a voltage approximately equal to ground voltage. As voltage of the central node B increases while the voltage at the feedback control node A remains approximately zero, current flows through the feedback control transistor-like element $M_3$ into the current mirror node C, capacitively increasing the voltage of the current mirror node C. As the voltage of the current mirror node C increases, current begins to flow through the feedback-generating transistor-like element $M_5$.

When a current path through the feedback control transistor-like element $M_3$ and the feedback-generating transistor-like element $M_5$ begins to form between the central node B and ground through the compensation current path $I_B$, any residual capacitive charge at the central node B is discharged. As the voltage at the central node B is reduced, a quiescent current begins to flow through the first resistive-like element R1, creating a voltage difference between the supply signal $V_{DD}$ and the central node B.

The First Current Path $I_A$ and the Compensation Current Path $I_B$

Within the first current path $I_A$, the voltage difference between the supply signal $V_{DD}$ and the central node B imposes a gate-to-source voltage $V_{GS1}$ on the current source transistor-like element $M_1$. The gate-to-source voltage $V_{GS1}$ causes a current to flow through the current source transistor-like element $M_1$ and through the first current path $I_A$.

Current through the first current path $I_A$ passes through the current source transistor-like element $M_1$ and through the feedback transistor-like element $M_4$ to ground.

Within the compensation current path $I_B$, the voltage difference between the supply signal $V_{DD}$ and the central node B also creates a current in the compensation current path $I_B$ through the first resistive-like element $R_1$. In accordance with Ohm's law, the current in the compensation current path $I_B$ is $I_B=V_{GS1}/R_1$. The current passes through the first resistive-like element $R_1$ and through both the feedback control transistor-like element $M_3$ and through the feedback-generating transistor-like element $M_5$ to ground.

Advantageously, the feedback-generating transistor-like element $M_5$ and the feedback transistor-like element $M_4$ form a feedback current mirror that stabilizes the current through the first current path $I_A$ and the current through the compensation current path $I_B$. If the current through the compensation current path $I_B$ increases, for example, then the gate-to-source voltage of the feedback-generating transistor-like element $M_5$ increases accordingly, increasing the gate-to-source voltage of the feedback transistor-like element $M_4$ across the feedback current mirror formed by the feedback-generating transistor-like element $M_5$ and the feedback transistor-like element $M_4$. The consequently greater voltage at the feedback control node A restricts the current through the feedback control transistor-like element $M_3$, curtailing the current through the compensation current path $I_B$.

Similarly, if the current through the compensation current path $I_B$ decreases, then the gate-to-source voltage of the feedback-generating transistor-like element $M_5$ decreases accordingly, decreasing the gate-to-source voltage of the feedback transistor-like element $M_4$ across the feedback current mirror formed by the feedback-generating transistor-like element $M_5$ and the feedback transistor-like element $M_4$. The consequently lower voltage at the feedback control node A allows more current to flow through the feedback control transistor-like element $M_3$, increasing the current through the compensation current path $I_B$.

Thus, there are two independent relationships between the first current path $I_A$ and the compensation current path $I_B$. First, the voltage across the gate and source terminals of the current source transistor-like element $M_1$ (i.e., the voltage difference between the supply signal $V_{DD}$ and the central node B) is equal to the voltage across the first resistive-like element $R_1$. Second, the current through the feedback-generating transistor-like element $M_5$ is related to the feedback transistor-like element $M_4$ across the feedback current mirror. The two independent relationships provide a restorative feedback that maintains the current through the first current path $I_A$ (and the current through the compensation current path $I_B$) substantially constant.

The First Current Path $I_A$ and the Second Current Path $I_C$

The voltage difference $VGS_1$ of the current source transistor-like element $M_1$ is further mirrored on the output transistor-like element $M_2$ to produce a current through the second current path $I_C$. In other words, the current source transistor-like element $M_1$ and the output transistor-like element $M_2$ form an output current mirror that produces a current through the second current path $I_C$.

A current divider serves to stabilize the voltage at the output node $V_{REF}$ by stabilizing the current through the thermal coupling transistor-like element $M_6$ and through the second resistive-like element $R_2$. The current through the second current path $I_C$ is divided between the thermal coupling transistor-like element $M_6$ and the second resistive-like element $R_2$. The voltage at the output node $V_{REF}$ is applied as a gate-to-source voltage of the thermal coupling transistor-like element $M_6$, causing a current $I_{M6}$ to flow through the thermal coupling transistor-like element $M_6$. The voltage at the output node $V_{REF}$ is also applied across the second resistive-like element $R_2$, causing a current $I_{R2}$ to flow through the second resistive-like element $R_2$.

When the output capacitor-like element $C_1$ draws no current, the current $I_{M6}$ through the thermal coupling transistor-like element $M_6$ and the current $I_{R2}$ through the second resistive-like element $R_2$ may be added together to total the current through the second current path $I_C$. If the voltage at the output node $V_{REF}$ increases, the resulting increase in gate-to-source voltage across the thermal coupling transistor-like element $M_6$ draws more current through the thermal coupling transistor-like element $M_6$, attenuating the current through the second resistive-like element $R_2$ and thereby restoring voltage at the output node $V_{REF}$.

Similarly, if the voltage at the output node $V_{REF}$ decreases, the resulting decrease in gate-to-source voltage across the thermal coupling transistor-like element $M_6$ restricts current through the thermal coupling transistor-like element $M_6$ and diverts more of the current through the second current path $I_C$ toward the second resistive-like element $R_2$, thereby restoring the voltage at the output node $V_{REF}$. Since the current-to-voltage relationship of the thermal coupling transistor-like element $M_6$ is independent of the current-to-voltage relationship of the second resistive-like element $R_2$, while the voltages (the voltage at the output node $V_{REF}$) are identical and the current must total the current through the second current path $I_C$, the two independent current-to-voltage relationships provide a restorative feedback that maintains the voltage at the output node $V_{REF}$ substantially constant.

The temperature dependence of the current source resistive-like element $M_1$ is removed by compensation with the thermal coupling transistor-like element $M_6$, in combination with the first resistive-like element $R_1$ and the second resistive-like element $R_2$. The current source transistor-like element $M_1$ and the thermal coupling transistor-like element $M_6$ have complementary thermal coefficients. The current source transistor-like element $M_1$ is a PMOS transistor, and consequently may be expected to have a positive temperature coefficient. As temperature increases, current in the first current path $I_A$ through the current source transistor-like element $M_1$ may be expected to increase. The increase in current is mirrored into the second current path $I_C$ across the output current mirror formed by the current source transistor-like element $M_1$ and the output transistor-like element $M_2$, increasing the current through the parallel combination of the thermal coupling transistor-like element $M_6$ and second resistive-like element $R_2$. Without temperature compensation, the output reference voltage would vary with $V_{GS1}$, in accordance with the relationship:

$$V_{REF}=V_{GS1}*(R_2/R_1), \text{ or}$$

$$\partial V_{REF}/\partial T=(R_2/R_1)(\partial V_{GS1}/\partial T)>0, \text{ where } T=\text{temperature.}$$

The thermal coupling transistor-like element $M_6$ provides the necessary thermal compensation to maintain the output reference voltage regardless of thermal variations in $V_{GS1}$. The thermal coupling transistor-like element $M_6$ is an NMOS transistor, and consequently may be expected to have a negative temperature coefficient. As temperature increases, current through the thermal coupling transistor-like element $M_6$ may be expected to decrease, and consequently greater current is directed through the second transistor $R_2$. Since the increase in temperature has restricted the ability of the thermal coupling transistor-like element $M_6$ to conduct current, even more of the current passes through the second resistive-like element $R_2$. However, as mentioned above in connection with the FIG. 1 circuit, the increased current flow through the second resistive-like element $R_2$ will increase the voltage across the second resistive-like element $R_2$, thereby increasing current flow through the thermal coupling transistor-like element $M_6$ and offsetting the temperature-induced decrease of current through the thermal coupling transistor-like element $M_6$.

Output Capacitor-like Element C1

Further, output capacitor-like element $C_1$ improves the stability of the output node $V_{REF}$. The output capacitor-like element $C_1$ and the second resistive-like element $R_2$ form an RC circuit that serves to stabilize the output reference voltage at the output node $V_{REF}$ by slowing variations in the output node $V_{REF}$.

In view of the foregoing, it will be understood by those skilled in the art that the methods of the present invention can provide a reference voltage with substantial temperature immunity in response to a supply voltage. The above-described embodiments have been provided by way of example, and the present invention is not limited to these examples. Multiple variations and modifications to the disclosed embodiments will occur, to the extent not mutually exclusive, to those skilled in the art upon consideration of the foregoing description. For example, various resistive-like element combinations can replace the first and second resistive-like elements. Moreover, various combinations of the current source transistor-like element and the thermal coupling transistor-like element with opposite temperature coefficients can be implemented. Additionally, other combinations, omissions, substitutions and modifications will be apparent to the skilled artisan in view of the disclosure herein. Accordingly, the present invention is not intended to be limited by the disclosed embodiments, but is to be defined by reference to the appended claims.

What is claimed is:

1. A reference voltage generators comprising:

a first current source operative to generate a first current, the first current source having a first temperature coefficient and comprising a transistor coupled to apply a gate-source voltage difference on a first resistive element to generate a compensation current;

an output current minor operatively coupled to mirror the first current and to generate a second current in response to the first current;

an output device operative to provide a reference voltage in response to the second current; and a shunt device, having a second temperature coefficient the same as the first temperature coefficient, operatively coupled in parallel with the output device.

2. The reference voltage generator as set forth in claim 1, wherein the first current source is a PMOS transistor.

3. The reference voltage generator as set forth in claim 1, wherein the shunt device is operative to restore the reference voltage in response to variations in the first current.

4. The reference voltage generator as set forth in claim 1, wherein the shunt device is operative to restore the reference voltage in response to temperature-dependent variations in the first current.

5. The reference voltage generator as set forth in claim 1, further comprising a compensation element operative to conduct a compensation current that varies in response to the first current, such tat a one-to-one correspondence exists between the compensation current and the first current.

6. The reference voltage generator as set forth in claim 5, further comprising a feedback element operative to conduct the compensation current such that the compensation current varies inversely in response to the first current, such that an inverse one-to-one correspondence exists between the first current and the compensation current, and wherein the feedback element and the compensation element operate to restore the first current to a substantially constant first current.

7. The reference voltage generator as set forth in claim 5, wherein the compensation element is a first resistive element.

8. The reference voltage generator as set forth in claim 1, further comprising a feedback element operative to conduct a compensation current that varies inversely in response to the first current, such that a one-to-one correspondence exists between the compensation current and the first current.

9. The reference voltage generator as set forth in claim 1, wherein the output device is a second resistive element coupled to be applied with the second current to generate the reference voltage.

10. A method for generating a reference voltage, comprising:

generating a first current with a current source having a first temperature coefficient, whereby a first gate-source voltage difference is applied to both a transistor and a first resistive element;

mirroring the first current and generating a second current in response to the first current;

providing a reference voltage in response to the second current; and shunting a current with a shunt device, which has a second temperature coefficient the same as the first temperature coefficient and which is coupled in parallel with the second current.

11. The method for generating a reference voltage as set forth in claim 10, wherein the generating of a first current having a first temperature coefficient includes applying the first gate-source voltage difference to a PMOS transistor.

12. The method for generating a reference voltage as set forth in claim 10, wherein the shunting of a current having a second temperature coefficient the same as the first temperature coefficient in parallel with the second current further includes restoring the reference voltage in response to variations in the first current.

13. The method for generating a reference voltage as set forth in claim 10, wherein the shunting of a current having a second temperature coefficient the same as the first temperature coefficient in parallel with the second current further includes restoring the reference voltage in response to temperature-dependent variations in the first current.

14. The method for generating a reference voltage as set forth in claim 10, wherein the generating of a first current having a first temperature coefficient includes:

applying a first gate-source voltage difference to a first resistive element; and conducting a compensation current that varies in response to the first current, such that a one-to-one correspondence exists between the compensation current and the first current.

15. The method for generating a reference voltage as set forth in claim 14, further comprising conducting the compensation current such that the compensation current varies inversely in response to the first current, such that an inverse one-to-one correspondence exists between the first current and the compensation current, and wherein a feedback element and a compensation element operate to restore the first current to a substantially constant first current.

16. The method for generating a reference voltage as set forth in claim 10, further comprising conducting a compensation current that varies inversely in response to the first current, such that a correspondence exists between the compensation current and the first current.

17. The method for generating a reference voltage as set forth in claim 10, farther comprising applying the reference voltage to a second resistive element.

18. A reference voltage generator, comprising:

a first resistive element;

a PMOS transistor coupled to apply a gate-source voltage difference on the first resistive element to generate a first current;

a current mirror for mirroring the first current to generate a second current;

a second resistive element coupled to be applied with the second current to thereby generate a reference voltage; and an NMOS transistor connected to the second resistive element in parallel for compensating a variation of the gate-source voltage difference.

19. The reference voltage generator as set forth in claim 18, farther comprising a capacitive element connected to the second resistive element in parallel.

* * * * *